US009444201B2

(12) United States Patent
Chen et al.

(10) Patent No.: US 9,444,201 B2
(45) Date of Patent: Sep. 13, 2016

(54) ELECTRIC CONNECTOR

(71) Applicant: Advanced-Connectek Inc., New Taipei (TW)

(72) Inventors: Ching-Tien Chen, New Taipei (TW); Shu-Lin Duan, Kunshan (CN); Wei Wan, Kunshan (CN); Fu-Yi Xu, Kunshan (CN); Pei-Hsuan Huang, New Taipei (TW)

(73) Assignee: Advanced-Connectek Inc., New Taipei (TW)

( * ) Notice: Subject to any disclaimer, the term of this patent is extended or adjusted under 35 U.S.C. 154(b) by 0 days.

(21) Appl. No.: 14/631,916

(22) Filed: Feb. 26, 2015

(65) Prior Publication Data

US 2015/0263468 A1 Sep. 17, 2015

(30) Foreign Application Priority Data

Mar. 13, 2014 (CN) ..... 2014 1 0090833

(51) Int. Cl.
*H01R 13/648* (2006.01)
*H01R 24/62* (2011.01)
*H01R 13/6477* (2011.01)

(52) U.S. Cl.
CPC ..... *H01R 24/62* (2013.01); *H01R 13/6477* (2013.01)

(58) Field of Classification Search
CPC ..... H01R 13/65802; H01R 13/6581; H01R 13/6597; H01R 24/60; H01R 13/641; H01R 23/02
USPC ..... 439/607.01, 607.34, 489, 660
See application file for complete search history.

(56) References Cited

U.S. PATENT DOCUMENTS 5,580,280 A * 12/1996 Minich ..... H01R 13/6625 333/182
6,106,335 A * 8/2000 Merchant ..... H01R 13/506 439/620.23
7,575,454 B1 * 8/2009 Aoki ..... H01R 13/641 439/188

* cited by examiner

*Primary Examiner* — Abdullah Riyami
*Assistant Examiner* — Thang Nguyen
(74) *Attorney, Agent, or Firm* — Alan D. Kamrath; Kamrath IP Lawfirm, P.A.

(57) ABSTRACT

An electric connector includes an insulation body, a shielding shell, first and second conductive terminals, and an organizer. The insulation body has a base portion and a tongue portion extended horizontally forward from the base portion. The shielding shell encloses the insulation body. Each first or second conductive terminal has a retaining section fixedly located in the insulation body, a contact section extended forward from the retaining section and located on the tongue portion, and a soldering section bent upward from the retaining section and extended outside the base portion. The organizer located on the base portion has an elongate slot and apertures that penetrate the base portion. The elongate slot allows the soldering sections of the first conductive terminals to pass through and anchor therein. Each aperture allows the soldering section of each second conductive terminal to pass through and anchor therein.

6 Claims, 10 Drawing Sheets

ELECTRIC CONNECTOR

BACKGROUND OF THE INVENTION

1. Field of the Invention

The present invention relates to an electric connector and, particularly, to an electric connector equipped with an organizer to allow soldering sections of conductive terminals to pass through and anchor.

2. Description of the Prior Art

The present signal transmission standard of Universal Serial Bus (USB) has advanced from USB 1.0/2.0 to a faster speed USB 3.0. Electric connectors conformed to the USB 3.0 standard can form electric connection with other electric connectors that also conform to the USB 3.0 standard to do signal transmission according to the USB 3.0 standard. In addition, the electric connectors conformed to the USB 3.0 standard also can form electric connection with electric connectors conformed to USB 1.0/2.0 standard to do signal transmission according to the USB 1.0/2.0 standard. In order to make the electric connector conformed to the USB 3.0 standard compatible with the USB 3.0 and USB 1.0/2.0 standards, the electric connector should include at least one set of conductive terminals conformed to the USB 3.0 standard for signal transmission and another set of conductive terminals conformed to the USB 1.0/2.0 standard for signal transmission.

Please refer to FIGS. 1 and 2 for a conventional electric connector that conforms to the USB 3.0 standard. It includes an insulation body 1, a shielding shell 2, a plurality of first conductive terminals 3, a plurality of second conductive terminals 4 and an organizer 5. The first conductive terminals 3, including signal conductive terminals 3*a* and a ground conductive terminal 3*b*, are used to do signal transmission that conforms to the USB 3.0 standard, while the second conductive terminals 4 are used to do signal transmission that confirms to the USB 1.0/2.0 standard. The insulation body 1 has a base portion 11 and a tongue portion 12 extended horizontally forward from the base portion 11. The shielding shell 2 encloses the insulation body 1. The shielding shell 2 and the tongue portion 12 of the insulation body 1 jointly form a coupling space 10 to receive a corresponding electric connector inserted thereinto (not shown in the drawings). Each first conductive terminal 3 has a retaining section 31, a non-elastic contact section 32 and a soldering section 33. The retaining section 31 is fixedly located in the insulation body 1. The non-elastic contact section 32 is extended forward from the retaining section 31 into the coupling space 10 and located on the tongue portion 12. The soldering section 33 is bent upward from the retaining section 31 and extended outside the base portion 11 of the insulation body 1. Each second conductive terminal 4 also has a retaining section 41, an elastic contact section 42 and a soldering section 43. The retaining section 41 is fixedly located in the insulation body 1. The elastic contact section 42 is extended forward from the retaining section 41 into the coupling space 10 and located on the tongue portion 12. The soldering section 43 is bent upward from the retaining section 41 and extended outside the base portion 11. The organizer 5 is located on the base portion 11 of the insulation body 1, and has a plurality of apertures 51 penetrating the organizer 5. Each aperture 51 allows the soldering sections 33 and 43 of the first and second conductive terminals 3 and 4 to pass through respectively and anchor therein.

Although the apertures 51 of the organizer 5 respectively anchor the soldering sections 33 and 43 of the first and second conductive terminals 3 and 4 so that the soldering sections 33 and 43 are rightly positioned in all directions such as front and rear, and left and right, the organizer 5 thus formed is complicated in structure and consumes a greater amount of plastic material. Hence, production efficiency is lower, and the cost is higher. Moreover, for the conductive terminal to transmit high frequency signals, such as the first conductive terminal 3 that conforms to the USB 3.0 standard with the signal conductive terminal 3*a*, its soldering section 33 is covered by a greater amount of plastic material on the circumference. This downgrades its high frequency characteristics.

SUMMARY OF THE INVENTION

The present invention provides an electric connector with an organizer formed in a simpler structure and consuming less material.

To achieve the foregoing object, the electric connector of the invention includes an insulation body, a shielding shell, a plurality of first conductive terminals, a plurality of second conductive terminals and an organizer. The insulation body has a base portion and a tongue portion extended horizontally forwards from the base portion. The shielding shell encloses the insulation body. The shielding shell and the tongue portion jointly form a coupling space to house a coupling electric connector. Each of the first conductive terminals and the second conductive terminals has a retaining section, a contact section and a soldering section. The retaining section is fixedly located in the insulation body. The contact section is extended forward from the retaining section into the coupling space and located on the tongue portion. The soldering section is bent upward from the retaining section and extended outside the base portion. The organizer is located on the base portion and has a first elongate slot and a plurality of first apertures. The first elongate slot and the first apertures penetrate the organizer. The first elongate slot allows the soldering sections of the first conductive terminals to pass through and anchor therein. Each first aperture allows the soldering section of each second conductive terminal to pass through and anchor therein.

In one embodiment of the invention, the first elongate slot has a front inner wall and a rear inner wall opposing the front inner wall. The front inner wall or the rear inner wall has a plurality of ribs formed thereon, or both the front inner wall and the rear inner wall have respectively a plurality of ribs formed thereon. In addition, the front inner wall or the rear inner wall has a plurality of troughs where no ribs are formed. The troughs penetrate the organizer.

In another embodiment of the invention, the first elongate slot has a front inner wall and a rear inner wall opposing the front inner wall. The front inner wall or the rear inner wall has a plurality of troughs formed thereon, or both the front inner wall and the rear inner wall have respectively a plurality of troughs formed thereon. The troughs penetrate the organizer.

In yet another embodiment of the invention, the first conductive terminals include a plurality of signal conductive terminals and a ground conductive terminal. The first elongate slot is replaced by a plurality of T-shaped trenches and a second aperture. Each T-shaped trench has a second elongate slot and a notch communicating with the second elongate slot. Each second elongate slot, each notch and each second aperture penetrates the organizer. Each T-shaped trench allows the soldering section of each signal conductive terminal to run through and anchor therein. The second aperture allows the soldering section of the ground conductive terminal to run through and anchor therein.

In yet another embodiment of the invention, the organizer has a front wall and a rear wall opposing the front inner wall, and the T-shaped trenches and the second aperture are located in front of the first apertures. Each notch cuts through the front wall. Alternately, the T-shaped trenches and the second aperture are located behind the first apertures, and the notch cuts through the rear wall.

By the technique set forth above, the electric connector of the invention allows the soldering section of each of the first and second conductive terminals to be rightly positioned in all directions. The structure also is simpler and consumes less material. Hence, production efficiency increases, and the cost is lower. In addition, the soldering section of the first conductive terminals for high frequency signal transmission is covered by less plastic material on the circumference and, hence, can provide improved high frequency characteristics.

The foregoing, as well as additional objects, features and advantages of the invention will be more readily apparent from the following embodiments and detailed description, which proceed with reference to the accompanying drawings.

DESCRIPTION OF THE PREFERRED EMBODIMENTS

In the following embodiments, the same or similar elements are marked by the same or similar notations. Moreover, the terms of direction such as up, down, left, right, front and rear merely are based on the directions of the attached drawings from a use perspective, and are not the limitation of the invention.

Figure 1:
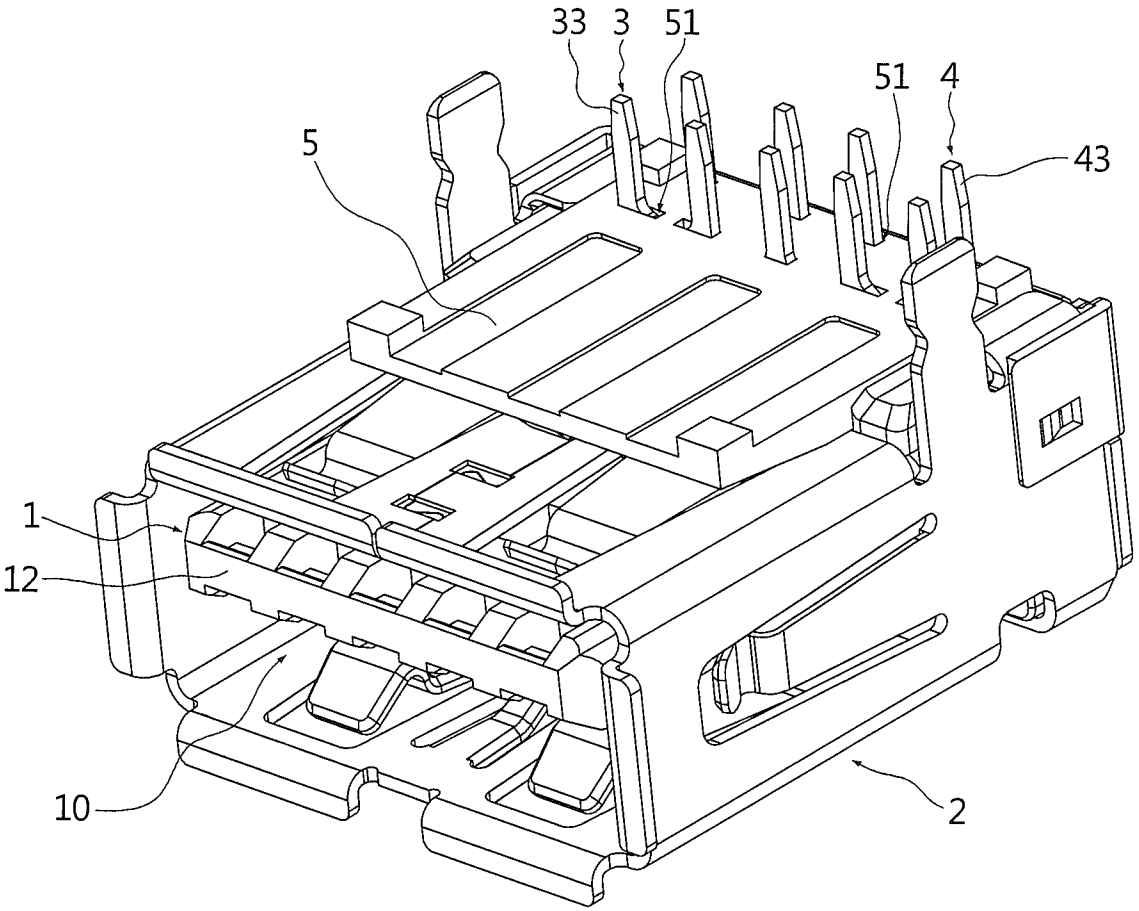
FIG. 1 (Prior Art)
FIGS. 1 and 2 are a perspective view and an exploded view of a conventional electric connector conformed to USB 3.0 standard.
Figure 2:
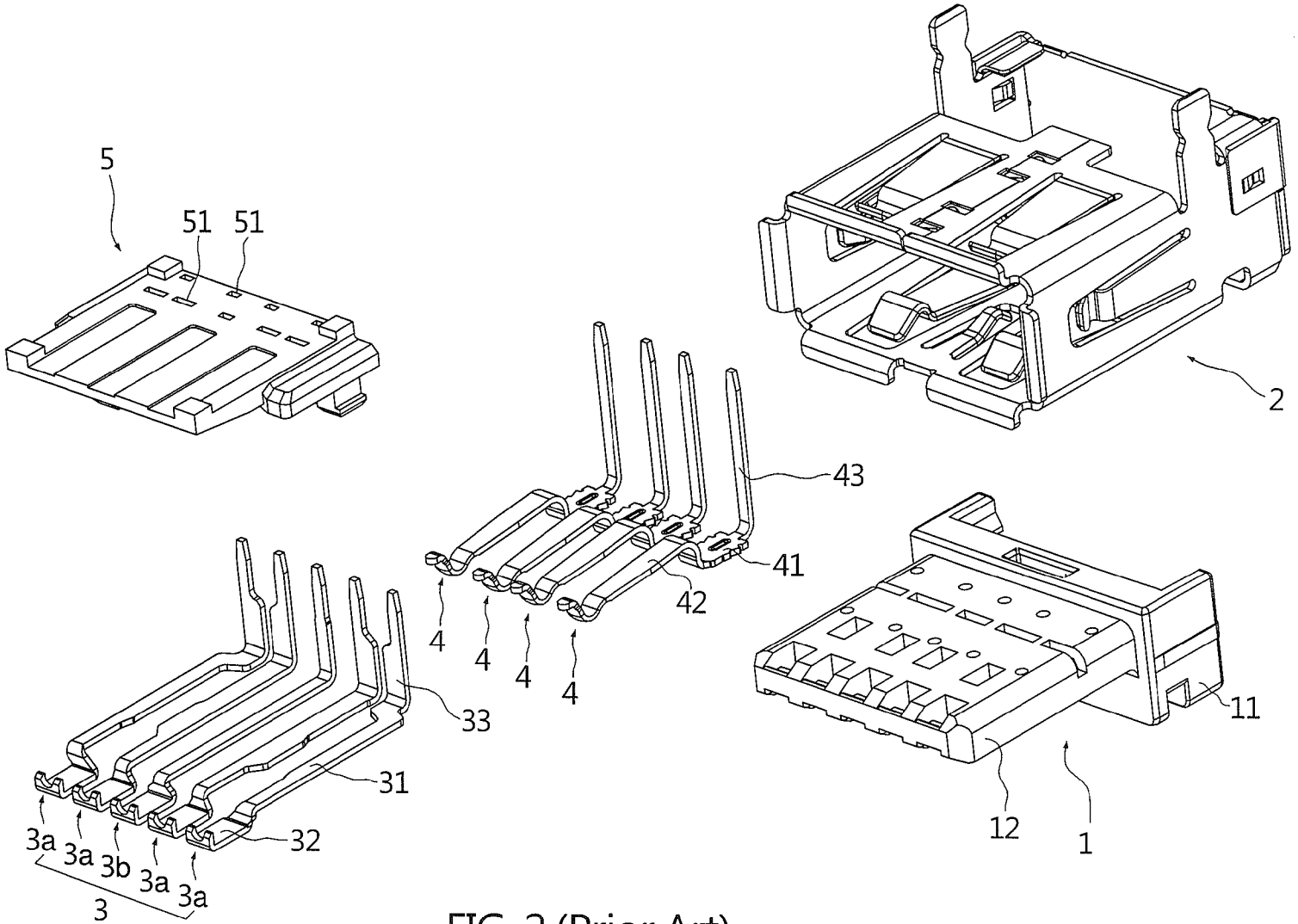
FIG. 2 (Prior Art)
Figure 3:
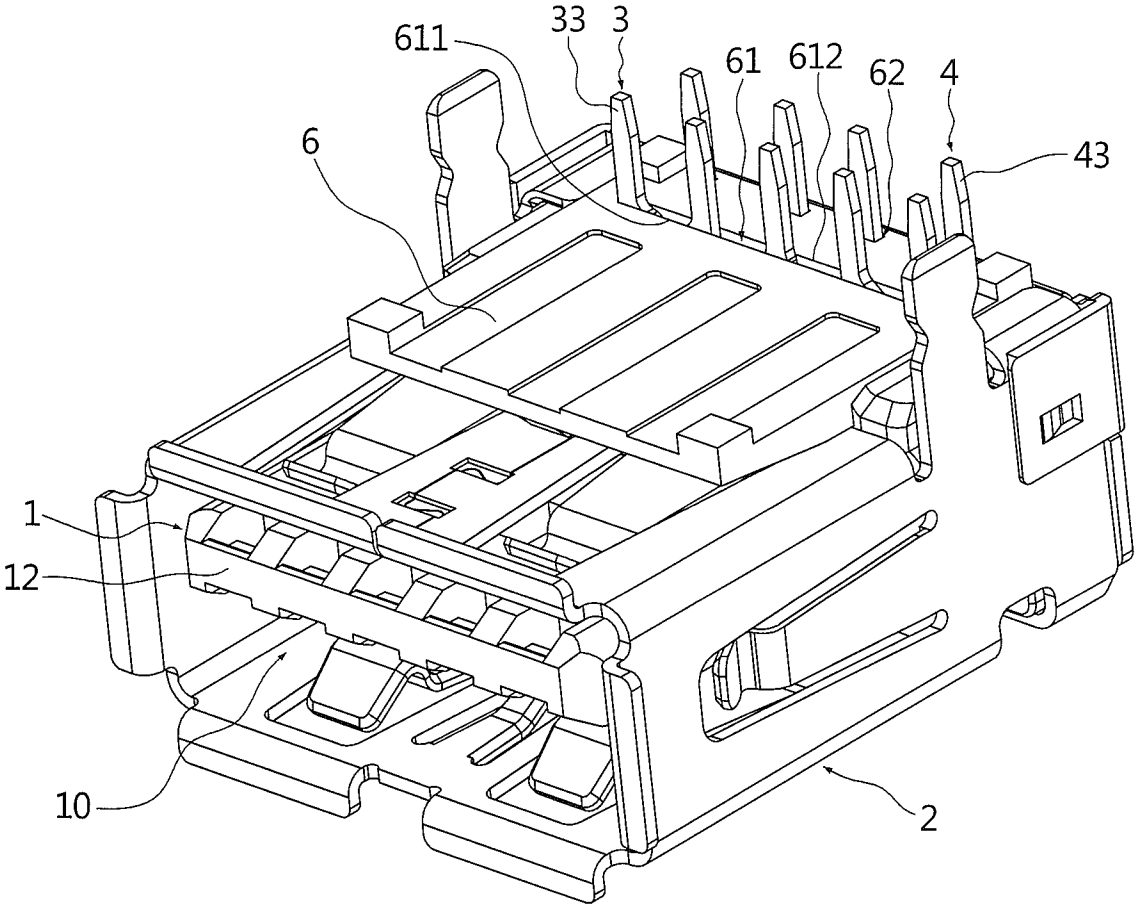
FIGS. 3 and 4 are a perspective view and an exploded view of a first embodiment of the electric connector of the invention.
Figure 4:
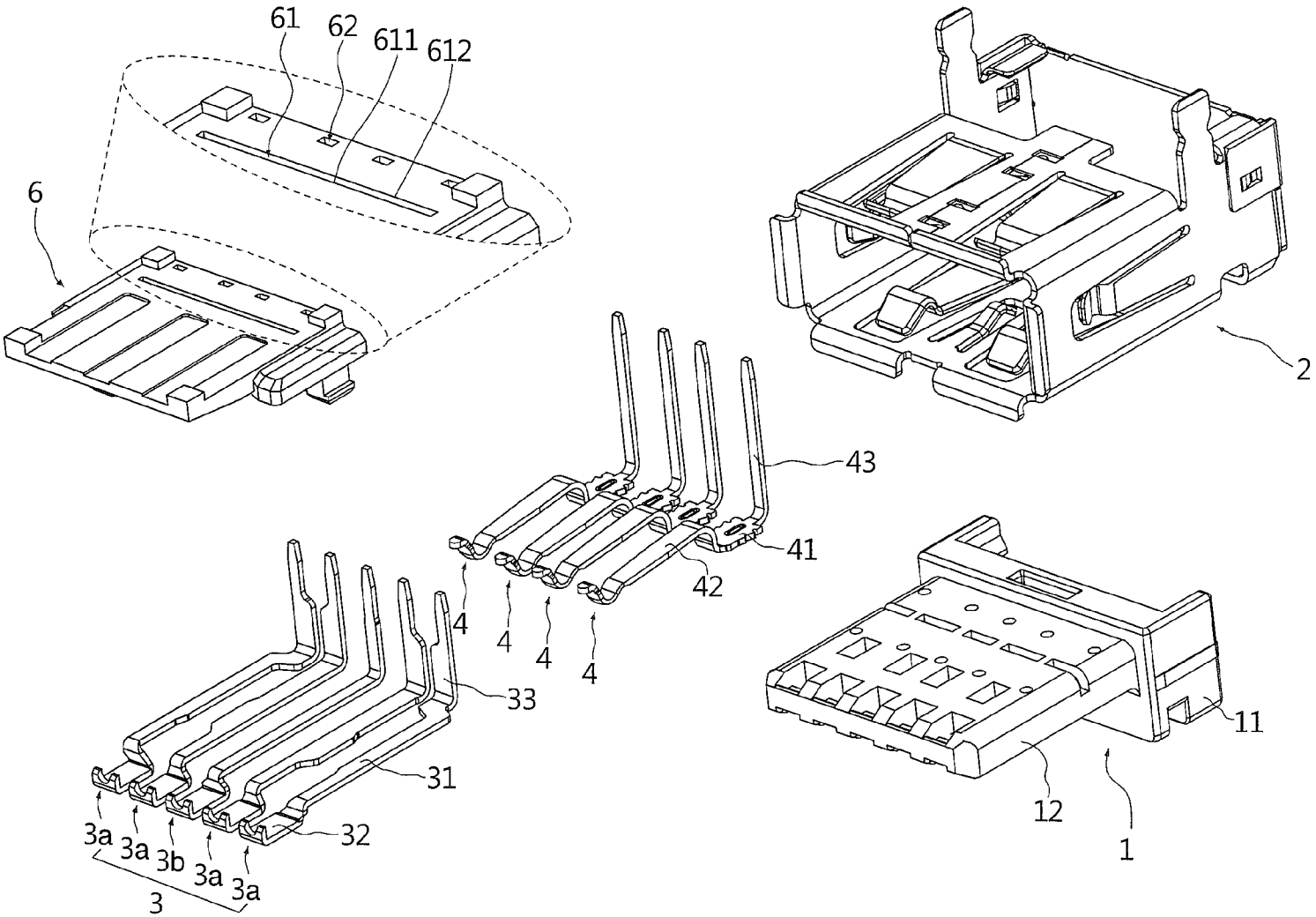

Please refer to FIGS. 3 and 4 for a first embodiment of the electric connector of the invention. The electric connector comprises an insulation body 1, a shielding shell 2, a plurality of first conductive terminals 3, a plurality of second conductive terminals 4 and an organizer 6. The electric connector can be one conforming to USB 3.0 standard as an example. The first conductive terminals 3 are used for signal transmission that conforms to USB 3.0 standard, while the second conductive terminals 4 are used for signal transmission that conforms to USB 1.0/2.0 standards. The insulation body 1 has a base portion 11 and a tongue portion 12 extended horizontally forwards from the base portion 11. The shielding shell 2 encloses the insulation body 1. The shielding shell 2 and the tongue portion 12 jointly form a coupling space 10 to house a coupling electric connector (not shown in the drawings). Each first conductive terminal 3 has a retaining section 31, a non-elastic contact section 32 and a soldering section 33. The retaining section 31 is fixedly located in the insulation body 1. The non-elastic contact section 32 is extended forward from the retaining section 31 into the coupling space 10 and located on the tongue portion 12. The soldering section 33 is bent upward from the retaining section 31 and extended outside the base portion 11. Each second conductive terminal 4 has a retaining section 41, an elastic contact section 42 and a soldering section 43. The retaining section 41 is fixedly located in the insulation body 1. The elastic contact section 42 is extended forward from the retaining section 41 into the coupling space 10 and located on the tongue portion 12. The soldering section 43 is bent upward from the retaining section 41 and extended outside the base portion 11.

The organizer 6 is located on the bottom of the base portion 11, and has a first elongate slot 61 and a plurality of first apertures 62 that penetrate respectively the organizer 6. The first elongate slot 61 allows the soldering sections 33 of all the first conductive terminals 3 to pass through and anchor thereon. Each first aperture 62 allows the soldering section 43 of one second conductive terminal 4 to pass through and anchor therein. The first elongate slot 61 has a front inner wall 611 and a rear inner wall 612 opposing the front inner wall 611. The front inner wall 611 and the rear inner wall 612 abut against respectively the soldering sections 33 of the first conductive terminals 3 to align the soldering sections 33 to be rightly positioned in the front and rear directions. In addition, the front inner wall 611 or the rear inner wall 612 can have a plurality of ribs formed thereon, or both the front inner wall 611 and the rear inner wall 612 can have a plurality of ribs formed thereon to align the soldering sections 33 to be rightly positioned in the left and right directions. In the embodiment, please refer to FIG. 5, the front inner wall 611 has a plurality of ribs 611*a* formed thereon.

Through the first elongate slot 61 of the organizer 6 in the first embodiment the soldering sections 33 of all the first conductive terminals 3 can extend through and be rightly positioned in all directions such as front, rear, left and right. Such a structure is simpler and consumes less material. Hence, production efficiency is higher, and the cost is lower. Furthermore, since the soldering sections 33 of the first conductive terminals 3 for high frequency transmission are covered by less plastic material on the circumferences, they have improved high frequency characteristics. In addition, the organizer 6 also provides a plurality of the first apertures 62 to allow the soldering sections 43 of the second conductive terminals 4 to extend through and position in a fit manner. Hence, the soldering sections 43 also can be rightly positioned in all directions such as front, rear, left and right.

Figure 5:
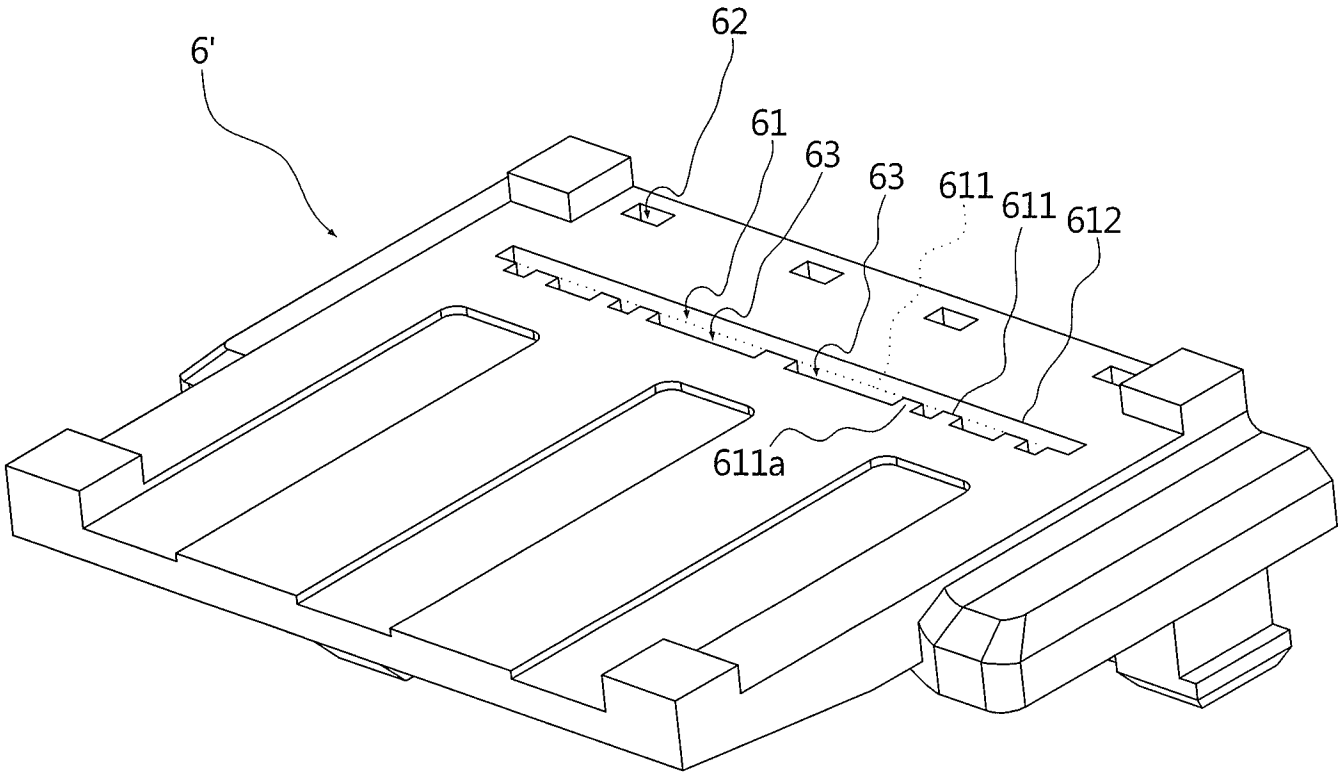
FIGS. 5 and 6, paragraph [0017] are schematic views of other two embodiments of the organizer of the electric connector of the invention in the first embodiment.

Please refer to FIG. 5 for another embodiment of the organizer used in the electric connector of the first embodiment. The organizer 6' in this embodiment differs from the organizer 6 shown in FIG. 4 by forming a plurality of troughs 63 on the front inner wall 611 of the first elongate slot 61. Each trough 63 penetrates the organizer 6' and is a slot with a tooth shape formed on a single side. Moreover, on the front inner wall 611 where no troughs 63 are formed, a plurality of ribs 611*a* are formed thereon. On the contrary, the front inner wall 611 without the ribs can have troughs 63 formed thereon. In this embodiment, since the organizer 6' adopts the first elongate slot 61 and a plurality of troughs 63 to form a slot with a tooth shape formed on a single side, the working piece produced via injection molds in such a shape can further have enhanced strength.

Figure 6:
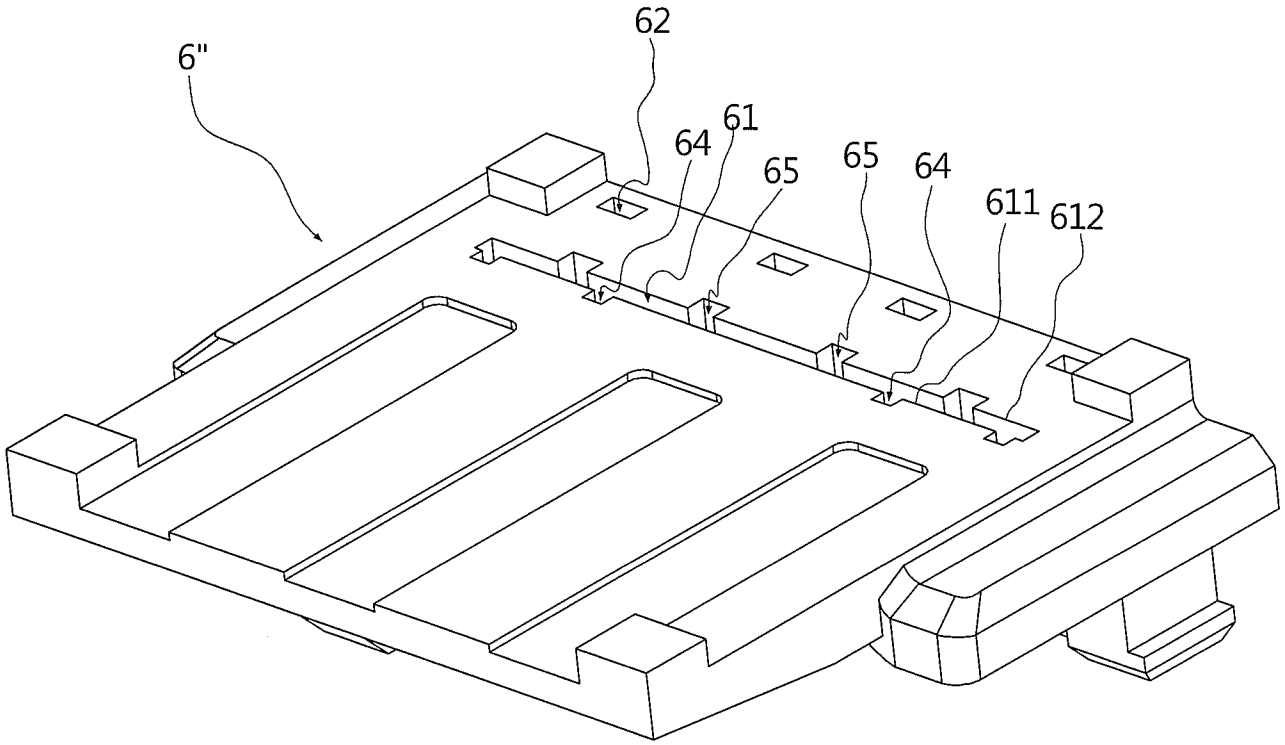

Please refer to FIG. 6 for yet another embodiment of the organizer used in the electric connector of the first embodiment. The organizer 6" in this embodiment differs from the organizer 6 shown in FIG. 4 by forming a plurality of troughs 64 on the front inner wall 611 of the first elongate slot 61, and also forming a plurality of troughs 65 on the rear inner wall 612. Each of the troughs 64 and 65 penetrates the organizer 6' and is a slot with a tooth shape formed on two sides. Moreover, on the front inner wall 611 where no troughs 64 are formed, a plurality of ribs is formed thereon. On the contrary, the front inner wall 611 without the ribs can have troughs 64 formed thereon, and the rear inner wall 612 without the ribs can also have troughs 65 formed thereon. In this embodiment, since the organizer 6" adopts the first elongate slot 61 and a plurality of troughs 64 and 65 to form a slot with a tooth shape formed on two sides, the working piece produced via injection molds in such a shape can further have enhanced strength.

Figure 7:
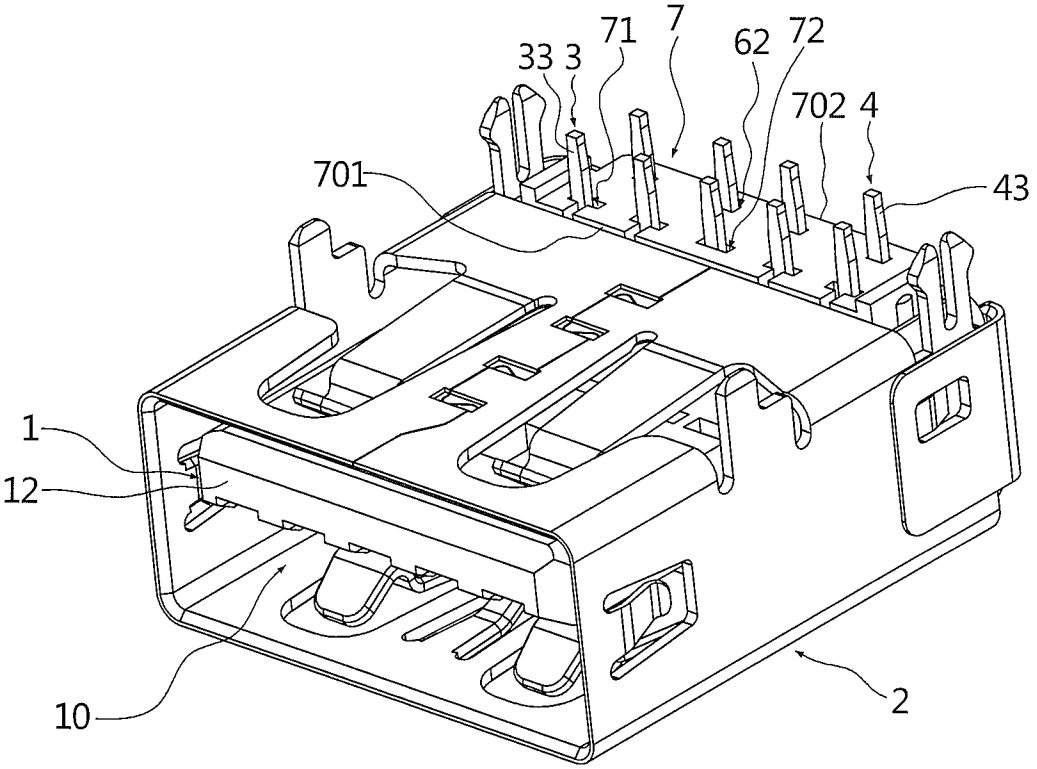
FIGS. 7 and 8 are a perspective view and an exploded view of a second embodiment of the electric connector of the invention.
Figure 8:
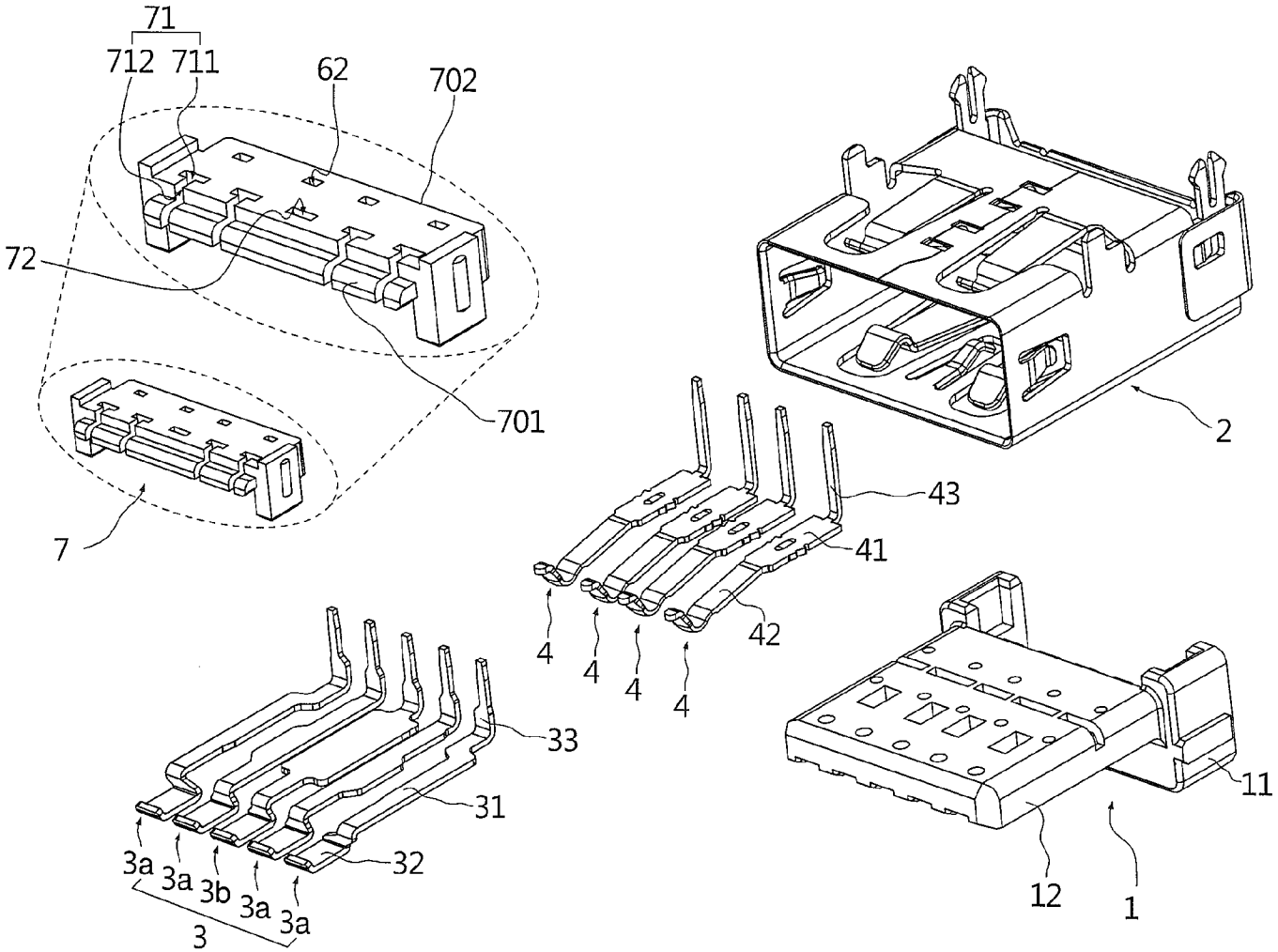

Please refer to FIGS. 7 and 8 for a second embodiment of the electric connector of the invention. It differs from the first embodiment shown in FIGS. 3 and 4 mainly on the organizer. An organizer 7 in this embodiment is formed by replacing the first elongate slot 61 of the organizer 6 in FIG. 4 by a plurality of T-shaped trenches 71 and a second aperture 72. Each T-shaped trench 71 has a second elongate slot 711 and a notch 712 communicating with the second elongate slot 711. Each second elongate slot 711, each notch 712 and the second aperture 72 penetrates respectively the organizer 7. Each T-shaped trench 71 allows the soldering section 33 of each signal conductive terminal 3*a* of the first conductive terminals 3 to pass through and anchor therein, and the second aperture 72 allows the soldering section 33 of the ground conductive terminal 3*b* to pass through and anchor therein. Moreover, each first aperture 62 allows the soldering section 43 of each second conductive terminal 4 to pass through and anchor therein. The second elongate slot 711 of each T-shaped trench 71 and the soldering section 33 of the signal conductive terminal 3*a* of each first conductive terminal 3 mate with each other so that the soldering section 33 of the signal conductive terminal 3*a* is rightly positioned in all directions such as front, rear, left and right. The notch 712 of each T-shaped trench 71 can reduce the plastic material used to cover the circumference of the signal conductive terminal 3*a* and also can improve high frequency characteristics. The second aperture 72 and the soldering section 33 of the ground conductive terminal 3*b* of the first conductive terminal 3 also mate with each other, so that the soldering section 33 of the ground conductive terminal 3*b* also is rightly positioned in all directions such as front, rear, left and right.

In the second embodiment, the soldering section 33 of the first conductive terminal 3 is located in front of the soldering section 43 of the second conductive terminal 4. Hence, the T-shaped trench 71 and the second aperture 72 of the organizer 7 are located in front of the first apertures 62. The organizer 7 has a front wall 701 and a rear wall 702 opposing the front wall 701. Hence, the notch 712 of the T-shaped trench 71 cuts through the front wall 701 of the organizer 7.

Figure 9:
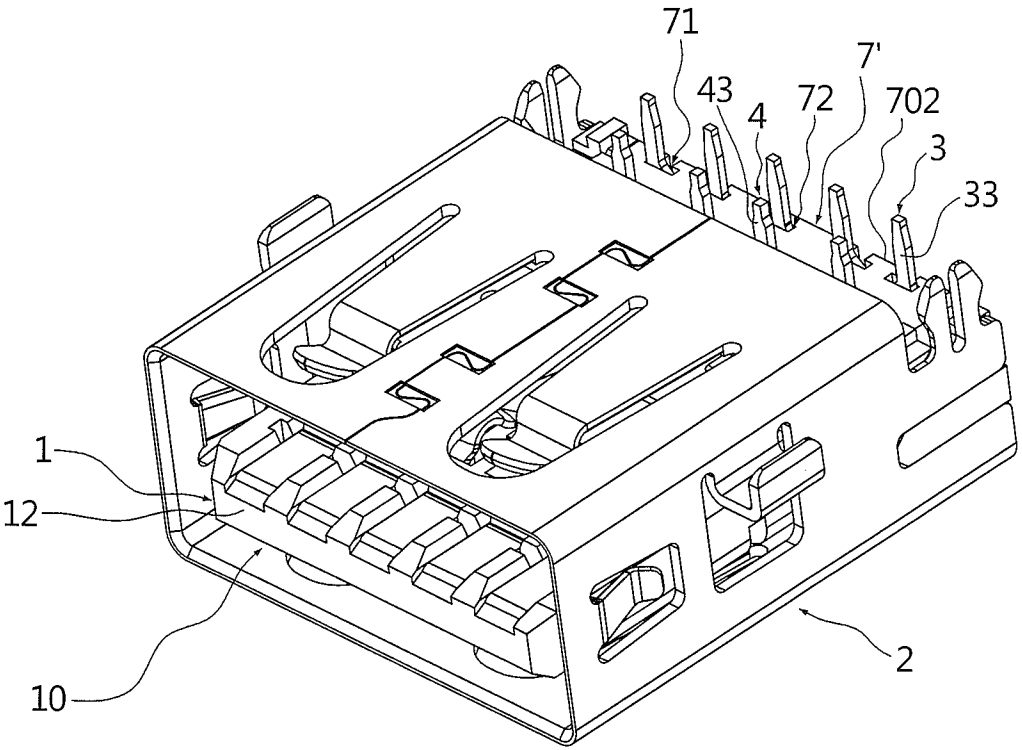
FIGS. 9 and 10 are a perspective view and an exploded view of a third embodiment of the electric connector of the invention.
Figure 10:
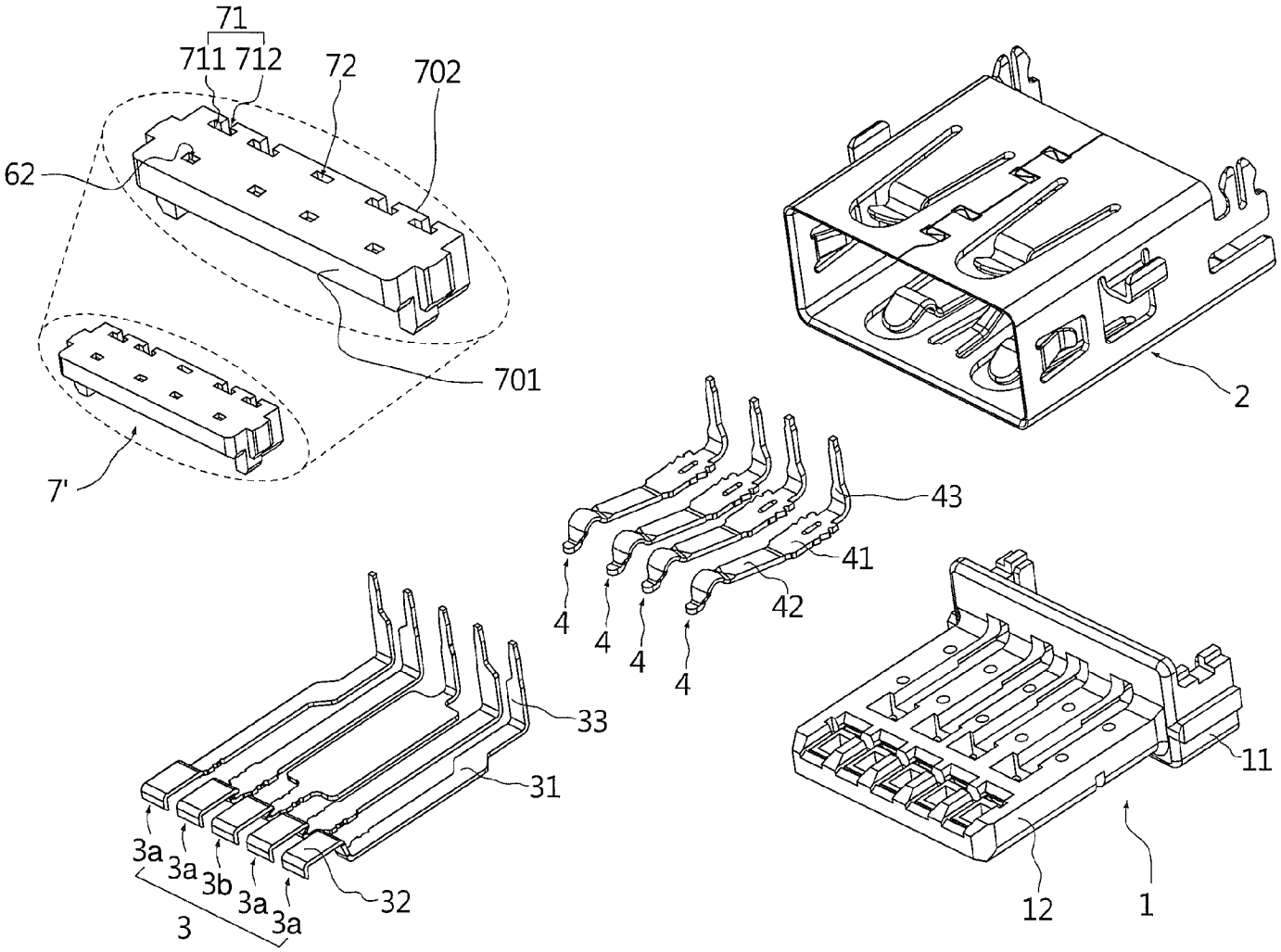

Please refer to FIGS. 9 and 10 for a third embodiment of the electric connector of the invention. It differs from the second embodiment shown in FIGS. 7 and 8 mainly on the locations of the soldering sections of the first and second conductive terminals that result in different locations of the notch of the T-shaped trench and the cut through direction thereof. In the third embodiment, the soldering section 33 of each first conductive terminal 3 is located behind the soldering section 43 of each second conductive terminal 4. Hence, the T-shaped trench 71 and the second aperture 72 of the organizer 7' are located behind the first apertures 62. The organizer 7' has a front wall 701 and a rear wall 702 opposing the front wall 701. Hence, the notch 712 of the T-shaped trench 71 cuts through the rear wall 702 of the organizer 7'.

While the preferred embodiments of the invention have been set forth for the purpose of disclosure, they are not the limitation of the invention. Modifications of the disclosed embodiments of the invention as well as other embodiments thereof may occur to those skilled in the art. Accordingly, the appended claims are intended to cover all embodiments which do not depart from the spirit and scope of the invention.

We claim:

1. An electric connector comprising:

an insulation body including a base portion and a tongue portion extended horizontally forward from the base portion;

a shielding shell enclosing the insulation body and collaborating with the tongue portion to form a coupling space to house a coupling electric connector;

a plurality of first conductive terminals and second conductive terminals that have respectively a retaining section, a contact section and a soldering section, with the retaining section fixedly located in the insulation body, with the contact section extended forward from the retaining section into the coupling space and located on the tongue portion, with the soldering section bent upward from the retaining section and extended outside the base portion; and an organizer located on the base portion and including a first elongate slot and a plurality of first apertures, with the first elongate slot and each first aperture penetrating the organizer, with the first elongate slot allowing the soldering sections of the first conductive terminals to pass through and anchor therein, with each first aperture allowing the soldering section of one second conductive terminal to pass through and anchor therein, wherein the first elongate slot includes a front inner wall and a rear inner wall opposing the front inner wall, with the front inner wall and/or the rear inner wall having a plurality of ribs formed thereon.

2. The electric connector of claim 1, wherein the front inner wall or the rear inner wall where no ribs are formed has a plurality of troughs formed thereon, with each trough penetrating the organizer.

3. An electric connector comprising:

an insulation body including a base portion and a tongue portion extended horizontally forward from the base portion;

a shielding shell enclosing the insulation body and collaborating with the tongue portion to form a coupling space to house a coupling electric connector;

a plurality of first conductive terminals and second conductive terminals that have respectively a retaining section, a contact section and a soldering section, with the retaining section fixedly located in the insulation body, with the contact section extended forward from the retaining section into the coupling space and located on the tongue portion, with the soldering section bent upward from the retaining section and extended outside the base portion; and an organizer located on the base portion and including a first elongate slot and a plurality of first apertures, with the first elongate slot and each first aperture penetrating the organizer, with the first elongate slot allowing the soldering sections of the first conductive terminals to pass through and anchor therein, with each first aperture allowing the soldering section of one second conductive terminal to pass through and anchor therein, wherein the first elongate slot has a front inner wall and a rear inner wall opposing the front inner wall, with the front inner wall and/or the rear inner wall having a plurality of troughs formed thereon, and with each trough penetrating the organizer.

4. An electric connector comprising:

an insulation body including a base portion and a tongue portion extended horizontally forward from the base portion;

a shielding shell enclosing the insulation body and collaborating with the tongue portion to form a coupling space to house a coupling electric connector;

a plurality of first conductive terminals and second conductive terminals that have respectively a retaining section, a contact section and a soldering section, with the retaining section fixedly located in the insulation body, with the contact section extended forward from the retaining section into the coupling space and located on the tongue portion, with the soldering section bent upward from the retaining section and extended outside the base portion; and an organizer located on the base portion and including a first elongate slot and a plurality of first apertures, with the first elongate slot and each first aperture penetrating the organizer, with the first elongate slot allowing the soldering sections of the first conductive terminals to pass through and anchor therein, with each first aperture allowing the soldering section of one second conductive terminal to pass through and anchor therein, wherein the plurality of first conductive terminals include a plurality of signal conductive terminals and a ground conductive terminal, with the first elongate slot comprising a plurality of T-shaped trenches and a second aperture, with each T-shaped trench having a second elongate slot and a notch communicating with the second elongate slot, with each second elongate slot, each notch and the second aperture penetrating the organizer, with each T-shaped trench allowing the soldering section of each signal conductive terminal to pass through and anchor therein, and with the second aperture allowing the soldering section of the ground conductive terminal to pass through and anchor therein.

5. The electric connector of claim 4, wherein the organizer has a front wall and a rear wall opposing the front wall, with the plurality of T-shaped trenches and the second aperture located in front of the first apertures, and with each notch cutting through the front wall.

6. The electric connector of claim 4, wherein the organizer has a front wall and a rear wall opposing the front wall, with the plurality of T-shaped trenches and the second aperture located behind the first apertures, and with each notch cutting through the rear wall.

* * * * *